US008683966B2

(12) United States Patent
Busse et al.

(10) Patent No.: US 8,683,966 B2
(45) Date of Patent: Apr. 1, 2014

(54) CAMSHAFT ADJUSTMENT DEVICE FOR AN INTERNAL COMBUSTION ENGINE

(75) Inventors: Michael Busse, Herzogenaurach (DE); Lutz Witthoeft, Aurachtal (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 421 days.

(21) Appl. No.: 13/057,925

(22) PCT Filed: Jul. 7, 2009

(86) PCT No.: PCT/EP2009/058622
§ 371 (c)(1),
(2), (4) Date: Feb. 7, 2011

(87) PCT Pub. No.: WO2010/015473
PCT Pub. Date: Feb. 11, 2010

(65) Prior Publication Data

US 2011/0139100 A1 Jun. 16, 2011

(30) Foreign Application Priority Data

Aug. 7, 2008 (DE) ..... 10 2008 036 877

(51) Int. Cl.
*F01L 1/34* (2006.01)

(52) U.S. Cl.
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,481,402 | B1 * | 11/2002 | Simpson et al. | 123/90.17 |
| 6,553,951 | B2 | 4/2003 | Ogawa | |
| 7,124,722 | B2 * | 10/2006 | Smith | 123/90.17 |
| 7,699,031 | B2 * | 4/2010 | Smith et al. | 123/90.17 |
| 8,267,058 | B2 * | 9/2012 | Suzuki et al. | 123/90.17 |
| 2002/0078913 | A1 * | 6/2002 | Fukuhara et al. | 123/90.17 |
| 2003/0196622 | A1 * | 10/2003 | Wada et al. | 123/90.17 |
| 2004/0211379 | A1 * | 10/2004 | Palesch et al. | 123/90.17 |
| 2006/0130789 | A1 * | 6/2006 | Smith | 123/90.17 |
| 2006/0213471 | A1 * | 9/2006 | Ogawa | 123/90.17 |
| 2010/0175650 | A1 * | 7/2010 | Suzuki et al. | 123/90.17 |
| 2010/0300388 | A1 * | 12/2010 | Lang et al. | 123/90.17 |
| 2010/0313835 | A1 * | 12/2010 | Yamaguchi et al. | 123/90.15 |

(Continued)

FOREIGN PATENT DOCUMENTS

| | | | |
|---|---|---|---|
| DE | 199 18 910 | A1 | 11/1999 |
| DE | 101 03 876 | A1 | 9/2001 |
| DE | 10 2006 012 349 | A1 | 9/2007 |
| DE | 10 2006 012 775 | A1 | 9/2007 |

*Primary Examiner* — Thomas Denion
*Assistant Examiner* — Steven D Shipe
(74) *Attorney, Agent, or Firm* — Lucas & Mercanti, LLP

(57) ABSTRACT

A camshaft adjustment device which has a pinion and a drive part that is disposed in a pivoting manner relative thereto. The pinion and the drive part are operatively connected to each other via a pressure chamber that can be pressurized using pressure means. At least one locking device can mechanically couple the pinion and the drive part. The locking device is actuated by of a pressure medium. The pressure chamber and the locking device are in a pressure medium connection to one another for regulating the pressure medium supply to the locking device and the pressure medium discharge therefrom by at least one regulating unit. The passage of the pressure medium can be blocked in a pressure-tight manner in the direction of the pressure chamber by at least one locking device disposed in the pressure medium connection.

3 Claims, 2 Drawing Sheets

(56) References Cited

U.S. PATENT DOCUMENTS

2011/0017156 A1* 1/2011 Smith ..... 123/90.15
2011/0139100 A1* 6/2011 Busse et al. ..... 123/90.15
2011/0232595 A1* 9/2011 Kokubo et al. ..... 123/90.17
2011/0259289 A1* 10/2011 Fujiyoshi ..... 123/90.15
2012/0186547 A1* 7/2012 Fujiyoshi et al. ..... 123/90.17

* cited by examiner

CAMSHAFT ADJUSTMENT DEVICE FOR AN INTERNAL COMBUSTION ENGINE

This application is a 371 of PCT/EP2009/058622 filed Jul. 7, 2009, which in turn claims the priority of DE 10 2008 036 877.6 filed Aug. 7, 2008, the priority of these applications is hereby claimed and these applications are incorporated by reference herein.

FIELD OF THE INVENTION

The invention relates to a camshaft adjusting apparatus having a drive input wheel and having a drive output part arranged so as to be rotatable relative to said drive input wheel, with the drive input wheel and drive output part being operatively connected by means of at least one pressure space which can be charged with pressure medium, and also having at least one locking device which can be actuated using pressure medium in order to mechanically couple the drive input wheel and drive output part, with the pressure space and locking device having a pressure medium connection to at least one regulating device for regulating the pressure medium supply to and pressure medium discharge from them.

BACKGROUND OF THE INVENTION

A camshaft adjusting apparatus of said type is known from DE 101 03 876 A1/U.S. Pat. No. 6,553,951 B2 and from US 2006/0213471 A1. In said documents, a housing component which can be driven by the motor of an internal combustion engine, and a rotor component which is connected to a camshaft for conjoint rotation therewith, are arranged so as to be rotatable relative to one another. To adjust a relative rotational phase angle between the rotor component and housing component, these are operatively connected to one another by means of a plurality of pressure spaces which are in each case divided, by a vane part connected to the rotor component for conjoint rotation therewith, into two pressure chambers which can be charged with pressure medium and which act counter to one another. The housing component and the rotor component can be mechanically coupled to one another by means of a blocking mechanism which can be actuated using pressure medium. The pressure chambers and the locking device have a pressure medium connection to a control valve for regulating the pressure medium supply to and from them. A disadvantage of said embodiment is the fact that, during an adjustment of the relative rotational phase angle between the rotor component and housing component, as a result of a periodic oscillation of the vane parts in the adjusting direction caused by the fluctuating torques acting on the camshaft, a vacuum may be generated in the pressure chambers to be filled, which vacuum can propagate via the pressure medium connection into the locking mechanism. If the locking pressure of the locking mechanism is undershot, this may lead, during an adjustment process, to an inadvertent locking or partial locking of the camshaft adjusting apparatus, and to a malfunction. This effect is promoted in particular by low pressure medium temperatures prevailing in the pressure medium system with high viscosity of the pressure medium, and/or by a large suction volume of the camshaft adjusting apparatus, that is to say if, for adjustment, a pressure medium volume flow is required which is large in relation to the adjustment angle.

SUMMARY OF THE INVENTION

The invention is therefore based on the object of providing a camshaft adjusting apparatus of the above-described type which avoids the above-stated disadvantages.

Since, according to the invention, the passage of the pressure medium can be blocked in a pressure-tight manner in the direction of the pressure space by means of at least one shut-off device arranged in the pressure medium connection between the pressure space, locking device and regulating device, a vacuum occurring in the pressure space can be reliably prevented from propagating via the pressure medium connection into the locking device, and inadvertent locking can be reliably prevented.

Here, the pressure space and locking device may have a pressure medium connection to at least one regulating device via in each case one separate pressure medium supply, with it being possible for the pressure medium connection between the locking device and regulating device and/or the pressure medium connection between the pressure space and regulating device to be shut off in the direction of the pressure space by means of at least one shut-off device.

It is however also conceivable for the pressure medium supply to the pressure space and locking device to take place via a common pressure medium connection between these and the regulating device, with a direct pressure medium connection being provided between the pressure space and locking device, which direct pressure medium connection can be shut off in the direction of the pressure space by means of at least one shut-off device.

For the pressure medium supply to the pressure space and locking device, it is also possible for a plurality of separate pressure medium lines to be provided which connect these and the regulating device and which can in each case be shut off in the direction of the pressure space by means of at least one shut-off device.

As a shut-off device, use may be made of any shut-off component which, when a vacuum occurs in the pressure space, prevents a flow of the pressure medium in the pressure medium connection in the direction of the pressure space. A fast-reacting shut-off valve may for example be arranged in the pressure medium connection.

If, in a preferred embodiment of the invention, to control the locking device, a control connection which is formed separately from the pressure medium supply of the pressure space is provided between the regulating device and locking device, then a vacuum occurring in the pressure space can in a simple manner be prevented from propagating into the locking device by arranging at least one shut-off device in the separate control connection.

In this way, it is possible for the passage of the pressure medium in the direction of the pressure space to be blocked directly in the separate control connection. In the event of charging with pressure medium, pressure medium in the control connection can flow only in the direction of the locking device. A return flow of the pressure medium out of the control connection into the pressure space via the control valve is reliably prevented by the shut-off device. In this way, the shut-off device ensures that, during an adjusting process, an inadvertent locking of the locking device is prevented.

Since the shut-off device is arranged in the control connection which is formed separately from the pressure medium supply of the pressure space, there is no impairment of the charging of the pressure space with pressure medium, and therefore no impairment of the adjusting speed of the camshaft adjusting apparatus, in particular as a result of a throttling action of the shut-off device.

Said arrangement is particularly advantageous if a plurality of pressure spaces are provided, in particular pressure spaces having in each case a plurality of separately controllable pressure chambers, which pressure chambers are charged with pressure medium via a plurality of pressure medium lines. By means of a shut-off device arranged in the separate control connection between the locking device and regulating device, the passage of the pressure medium can be shut off, directly in the control connection, in the direction of all the pressure spaces or pressure chambers simultaneously.

It is also conceivable that, for the pressure medium supply of the locking device, a plurality of pressure medium lines which form a separate control connection are provided, which pressure medium lines can in each case be shut off in the direction of the pressure space by means of at least one shut-off device.

It is also particularly advantageous if the shut-off device is designed as a check valve. In this way, a shut-off mechanism is provided which is of simple design and which, in the event of a vacuum occurring in the pressure medium connection, automatically and without complex control directly prevents a flow of the pressure medium in the direction of the pressure space and prevents the locking pressure from being undershot in the locking device.

In a further preferred embodiment of the invention, at least one check valve is arranged in a control inlet connection, which is formed separately from the pressure medium charging of the locking device, between the locking device and regulating device. Since the check valve permits the passage of the pressure medium in the pass-through direction only when the opening pressure is exceeded, that is to say only when the pressure difference, which is required for opening, upstream and downstream of the check valve is exceeded, the pressure medium in the control inlet connection can flow only in the direction of the locking device in the event of charging with pressure medium. A return flow of the pressure medium, and inadvertent locking as a result of the locking pressure being undershot in the locking device, is reliably prevented.

A simply-designed pressure medium outlet out of the locking device is made possible if a control outlet connection is provided which is connected in parallel with the control inlet connection and which connects the locking device to the regulating device.

It is also conceivable for the locking device to be composed of a plurality of locking units which can be charged with pressure medium via one or more control inlet lines which can in each case be shut off in the direction of the pressure space by means of at least one shut-off device. Here, for the pressure medium outlet out of the locking units, one or more control outlet lines may be provided which are connected in parallel with the control inlet lines.

It is advantageous for the check valve to have a low opening pressure. In this way, firstly, with a low pressure difference and low flow resistance, short reaction times are attained with a low throughflow rate, for example to compensate for leakage in the locking device, and secondly, reliable blocking of the passage in the blocking direction is ensured with a low restoring force acting on the blocking body of the check valve. Furthermore, fast opening of the check valve and delay-free response of the locking device are made possible with low pressure medium primary pressure in the pressure medium system.

To regulate the pressure medium supply of the locking device and of the pressure space or of the pressure chambers which form said pressure space, a regulating device is provided which is designed as a control valve. The control valve has two separate working ports which communicate with the pressure space or the pressure chambers. Here, it is provided that the control inlet connection communicates, at the valve side, only with a control inlet port which is formed separately from the working ports, and the control outlet connection communicates, at the valve side, only with a control outlet port with is formed separately from the working ports. In this way, the locking device and the pressure space or the pressure chambers can be controlled independently of one another.

BRIEF DESCRIPTION OF THE DRAWINGS

Further features of the invention will emerge from the following description and from the drawings, which illustrate an exemplary embodiment of the invention in simplified form. In the drawings.

DETAILED DESCRIPTION OF THE DRAWINGS

Figure 1:
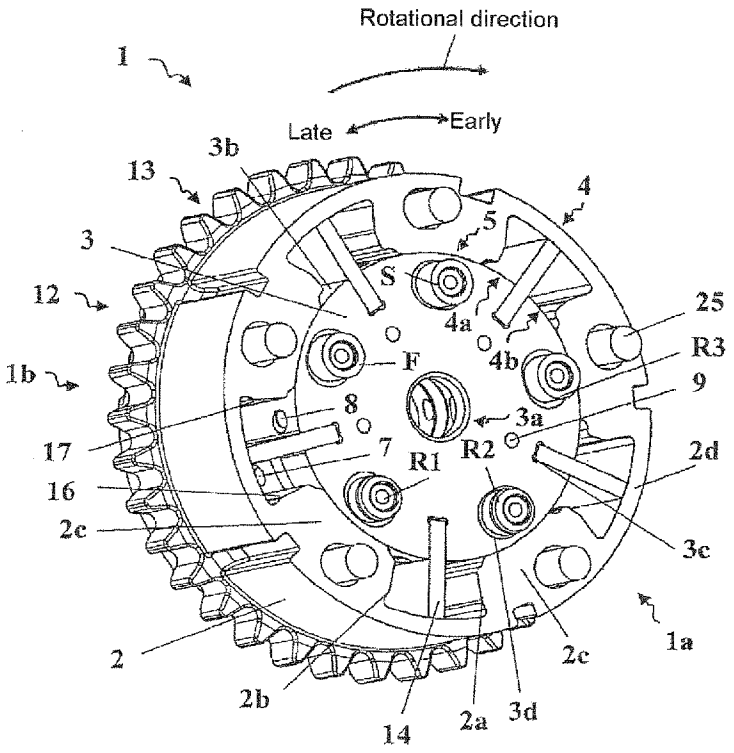
FIG. 1 shows a perspective illustration of the camshaft adjusting apparatus.
Figure 2:
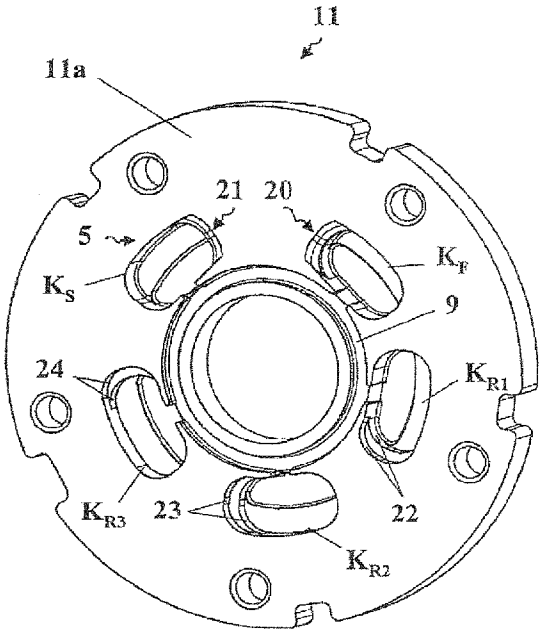
FIG. 2 shows a perspective illustration of a side cover of the camshaft adjusting apparatus.

FIG. 1 shows a perspective illustration of a hydraulic camshaft adjusting apparatus 1 without a side cover 11, viewed from the side 1*a* facing away from the engine. The side cover 11 is illustrated in a perspective view in FIG. 2. The camshaft adjusting apparatus 1 has a drive input wheel 2 which is mounted on a drive output part 3 so as to be rotatable relative thereto. The drive input wheel 2 can be driven via an engagement point 13, illustrated by way of example as a sprocket which is connected to the drive input wheel 2 for conjoint rotation therewith, on the toothing of which can engage a chain which is driven by a crankshaft (not illustrated). It is however also conceivable for the drive input wheel 2 to be driven via a belt drive or gear train. The drive output part 3 is designed as a vane wheel and is connected by means of a central receptacle 3*a* to a camshaft (not illustrated) for conjoint rotation therewith, for example by means of a screw connection or welded connection. The drive output part 3 has formed on it five vanes 14 which are distributed symmetrically over the circumference and which extend in the radially outer direction. Proceeding from the outer circumference 3*b*, the drive output part 3 has axially running vane grooves 3*c* which form radial depressions and in which the vanes 14 are arranged so as to be connected to the drive output part 3 for conjoint rotation therewith. On the side 1*a*, which faces away from the engine, and on the side 1*b*, which faces towards the engine, of the camshaft adjusting apparatus 1, in each case one side cover 11, 12 is arranged on each of the side surfaces of the drive input wheel 2 and is fixed thereto for conjoint rotation therewith by means of five fastening screws 25. In the drive input wheel 2, five pressure spaces 4 are provided which are arranged symmetrically with respect to one another in the circumferential direction. The pressure spaces 4 are delimited in the circumferential direction in each case by two substantially radially running boundary walls 2*a*, 2*b*, which are situated opposite one another, of adjacent projections 2*c* of the drive input wheel 2. In the radial direction, the pressure spaces 4 are delimited in each case in the radially outward direction by a circumferential wall 2*d* of the drive input wheel and in the radially inward direction by the outer circumference 3*b* of the drive output part 3. One of the vanes 14 projects into each of the pressure spaces 4, with the vanes 14 being designed such that they both bear against the circumferential wall 2*d* and can be placed in contact with the boundary walls 2*a*, 2*b* of the projections 2*c*. Each of the vanes 14 divides the respective pressure space 4 into two oppositely acting pressure chambers 4*a*, 4*h*.

The drive input wheel 2 is arranged so as to be rotatable relative to the drive output part 3 in a defined angle range. The angle range is limited in one rotational direction by virtue of each vane 14 coming to bear against a late stop 16 formed on the boundary wall 2*a* of the pressure space 4. Similarly, the angle range is limited in the other rotational direction by virtue of each vane 14 coming to bear against the early stop 17 formed on the opposite boundary wall 2*b* of the pressure space 4.

By charging one group of pressure chambers 4*a*, 4*b* with pressure medium and relieving the other group of pressure chambers 4*a*, 4*b* of pressure, the angular phase position of the drive input wheel 2 relative to the drive output part 3 can be varied in the rotational direction of the camshaft adjusting apparatus 1 in the direction of earlier control times (opening and closing times) of the gas exchange valves (not illustrated) or counter to the rotational direction of the camshaft adjusting apparatus 1 in the direction of later control times. By charging both groups of pressure chambers 4*a*, 4*b* with pressure medium, the phase position of the drive input wheel 2 and drive output part 3 relative to one another can be held constant.

For the supply of pressure medium to and discharge of pressure medium from the pressure chambers 4*a*, 4*b*, a pressure medium system is provided which comprises a pressure medium pump 18, a tank 19, a regulating device 6 designed as a hydraulic control valve, and pressure medium connections 7, 8. The lubricating oil of the internal combustion engine is conventionally used as hydraulic pressure medium.

In certain critical operating states, for example during the starting of the motor of the internal combustion engine or during idle phases or during the stopping of the engine, the pressure medium supply of the camshaft adjusting apparatus 1 may not be sufficient to ensure the hydraulic bracing of the vanes 14 within the pressure spaces. To prevent an uncontrolled oscillation of the drive output part 3 relative to the drive input wheel 2, a locking device 5 is provided by means of which the drive output part 3 and the drive input wheel 2 can be mechanically coupled to one another. The locking device 5 has five locking elements F, S, R1, R2, R3 which are arranged in an axially movable manner in an axial bore 3*d* in the drive output part 3, and five locking slotted guides $K_F$, $K_S$, $K_{R1}$, $K_{R2}$, $K_{R3}$ which are in each case of complementary design to said locking elements, with said locking slotted guides being arranged on the inner side 11*a*, which faces toward the drive output part 3, of the side cover 11 which is designed as a locking cover. Here, the locking elements F, S, R1, R2, R3 and the associated locking slotted guides $K_F$, $K_S$, $K_{R1}$, $K_{R2}$, $K_{R3}$ form in each case one locking unit. If the drive output part 3 is situated in a defined phase angle position relative to the drive input wheel 2, then it is possible in each case for the locking element F, S, R1, R2, R3 to engage into the locking slotted guide $K_F$, $K_S$, $K_{R1}$, $K_{R2}$, $K_{R3}$ assigned thereto and to produce a mechanical connection between the drive input wheel 2 and drive output part 3. The locking slotted guides $K_F$, $K_S$, $K_{R1}$, $K_{R2}$, $K_{R3}$ are in the form of grooves running in the circumferential direction. Each of the locking elements F, S, R1, R2, R3 is loaded axially with a force in the direction of the locking cover by means of a spring element. If the drive output part 3 moves relative to the drive input wheel 2 into a position in which one of the locking elements F, S, R1, R2, R3 is situated opposite the associated locking slotted guide $K_F$, $K_S$, $K_{R1}$, $K_{R2}$, $K_{R3}$ in the axial direction, then said locking element is pushed into the locking slotted guide $K_F$, $K_S$, $K_{R1}$, $K_{R2}$, $K_{R3}$ and is moved from an unlocked state into a locked state. To move the locking elements F, S, R1, R2, R3 from the locked state into the unlocked state, it is provided that the respective locking slotted guide $K_F$, $K_S$, $K_{R1}$, $K_{R2}$, $K_{R3}$ is charged with pressure medium. In this way, the respective locking element F, S, R1, R2, R3 is pushed back into the axial bore 3*c* counter to the force of the spring element, and the coupling between the drive input wheel 2 and the drive output part 3 is therefore eliminated. When pressure medium is discharged out of the locking slotted guides $K_F$, $K_S$, $K_{R1}$, $K_{R2}$, $K_{R3}$ and the locking pressure is undershot, the locking elements F, S, R1, R2, R3 can lock into the associated locking slotted guides $K_F$, $K_S$, $K_{R1}$, $K_{R2}$, $K_{R3}$ again when they are situated axially opposite.

The locking elements F, S and the associated locking slotted guides $K_F$, $K_S$ are designed such that a mechanical connection for conjoint rotation can be produced in a defined middle phase angle position (locking position) of the drive input wheel 2 relative to the drive output part 3 between the late stop 16 and the early stop 17 in the locked state. If the drive output part 3 is situated in the locking position relative to the drive input wheel 2, then the locking element F bears against a stop 20 formed in the early direction in the circumferential direction by the associated locking slotted guide $K_F$, as a result of which the phase angle position of the drive output part 3 relative to the drive input wheel 2 is restricted to a range between a maximum late position at the late stop 16 and the locking position, and an adjustment beyond the locking position in the direction of earlier control times is prevented. Similarly, the locking slotted guide $K_S$ is designed such that, when the locking element S is locked in the locking position, bears against a stop 21 formed in the circumferential direction in the late direction by the associated locking slotted guide $K_S$, as a result of which the phase angle position of the drive output part 3 relative to the drive input wheel 2 is restricted to a range between a maximum early position at the early stop 16 and the locking position, and an adjustment beyond the locking position in the direction of later control times is prevented.

If, as in the operating state described above, the pressure medium supply of the camshaft adjusting apparatus 1 is not capable of ensuring the hydraulic bracing of the vanes 14 within the pressure spaces 4, the relative phase angle position between the drive output part 3 and drive input wheel 2 is adjusted in the direction of the late stop 16 as a result of the influence of the friction torques acting on the camshaft. To permit, in this operating state, an adjustment of the camshaft adjusting apparatus 1 out of a relative phase angle position between the maximum late position at the late stop 16 and the locking position in the direction of earlier control times, further locking elements R1, R2, R3 are provided in the illustrated exemplary embodiment. The contours of the locking slotted guides $K_{R1}$, $K_{R2}$, $K_{R3}$, which are assigned to said further locking elements, on the locking cover have in each case two stepped stops 22, 23, 24 in the late direction. Said stops can be utilized doubly for the adjustment of the relative phase angle position in the early direction counter to the friction torques acting on the camshaft. In the early direction, the drive output part 3 can oscillate relative to the drive input wheel 2 until the alternating torque acting on the camshaft reverses into the late direction. In the late direction, the angle of oscillation of the drive output part 3 relative to the drive input wheel 2 is limited by the successive locking of the locking elements R1, R2, R3 against the respective stops 22, 23, 24 of the associated locking slotted guides $K_{R1}$, $K_{R2}$, $K_{R3}$ in the late direction. In this way, the phase angle position can be adjusted, without hydraulic drive, in the direction of earlier control times counter to the friction torques acting on the camshaft. When the locking position is reached, it is possible for the drive output part 3 and drive input wheel 2 to be mechanically coupled to one another for conjoint rotation by virtue of the locking elements F, S locking.

The locking slotted guides $K_F$, $K_S$, $K_{R1}$, $K_{R2}$, $K_{R3}$ are charged with pressure medium via a pressure medium connection 9, which is formed separately from the pressure medium supply of the pressure chambers 4*a*, 4*b*, between the control valve and the locking slotted guides $K_F$, $K_S$, $K_{R1}$, $K_{R2}$, $K_{R3}$.

Figure 3:
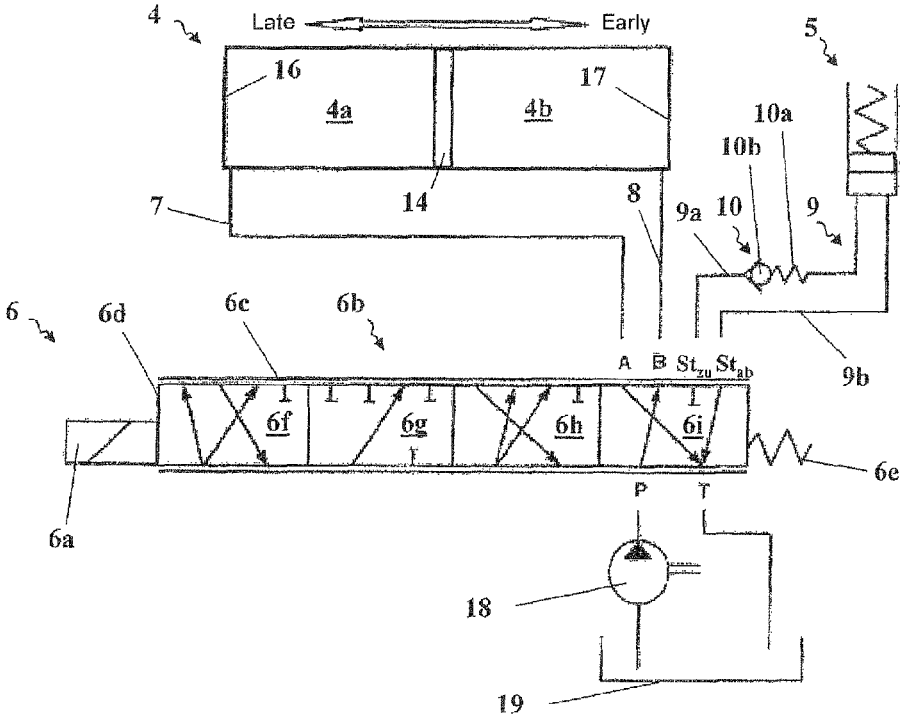
FIG. 3 shows a simplified schematic illustration of the design of the pressure medium system of the camshaft adjusting apparatus.

FIG. 3 shows, highly schematically and by way of example, a hydraulic diagram of the design of the pressure medium system of the camshaft adjusting apparatus 1. Indicated in said figure is a cross section through one of the five pressure spaces 4, which are divided in each case by a vane 14 into a first pressure chamber 4*a* and a second pressure chamber 4*b*. The supply of pressure medium to and discharge of pressure medium from the group of first pressure chambers 4*a* and the group of second pressure chambers 4*b* takes place in each case via separate pressure medium connections 7, 8 between these and the regulating device 6 designed as a control valve.

For the pressure medium supply of the locking device 5, a control connection 9, which is formed separately from the pressure medium connections 7, 8, is provided between the locking device 5 and the control valve. The pressure medium connection 9 is composed of a control inlet connection 9*a* and a separate control outlet connection 9*b* which is connected in parallel with said control inlet connection. Each of the locking slotted guides $K_F$, $K_S$, $K_{R1}$, $K_{R2}$, $K_{R3}$ of the locking device 5 is connected to the control valve 6 via the control inlet connection 9*a* and via the control outlet connection 9*b*. The locking slotted guides $K_F$, $K_S$, $K_{R1}$, $K_{R2}$, $K_{R3}$ can be charged with pressure medium via the control inlet connection 9*a*, and pressure medium can be discharged from said locking slotted guides via the control outlet connection 9*b*.

Here, it is provided that the control valve regulates both the pressure medium flows to and from the first and second pressure chambers 4*a*, 4*b* and also to and from the locking device 5. Four ports A, B, $St_{zu}$, $St_{ab}$ connect the control valve to the pressure chambers 4*a*, 4*b* and the locking device 5. A first working port A communicates with the pressure medium connection 7, via which pressure medium is supplied to the group of first pressure chambers 4*a*. The second working port B communicates with the pressure medium connection 8, via which pressure medium is supplied to the group of second pressure chambers 4*b*. A control inlet port $St_{zu}$, which is formed separately from the working ports A, B, communicates with the separate control inlet connection 9*a*, via which the locking slotted guides $K_F$, $K_S$, $K_{R1}$, $K_{R2}$, $K_{R3}$ of the locking device 5 can be charged with pressure medium. A further control outlet port $St_{ab}$ communicates with the separate control outlet connection 9*b*, via which pressure medium can be discharged from the locking slotted guides $K_F$, $K_S$, $K_{R1}$, $K_{R2}$, $K_{R3}$ to the control valve 6. An inlet port P for a pressure medium pump 18 provides a permanent pressure medium flow to the camshaft adjusting apparatus 1. Via an outlet port T, the pressure medium can flow out into a tank 19. The ports P and T can be connected to the oil circuit of the motor of the internal combustion engine, for example to the cylinder head gallery, with the oil pressure thereof being dependent on the engine speed and the oil temperature. The port T then allows the oil displaced in the camshaft adjusting apparatus 1 to flow back into the oil circuit of the motor.

The control valve 6 is composed of an electric actuating unit 6*a* and a hydraulic section 6*b*. The hydraulic section 6*b* has a valve housing 6*c* and an axially movable control piston 6*d*. The control piston 6*d* can be moved axially in the valve housing 6*c* as a function of the supply of electrical current to the electric actuating unit 6*a*, The spring force, which acts in the opposite direction, of a valve spring 6*e* permits a return movement of the control piston 6*d*. By axially moving the control piston 6*d*, the working ports A, B and the control inlet port $St_{zu}$ and the control outlet port $St_{ab}$ can be selectively connected to the inlet port P, to the outlet port T or to neither of these. In the control piston 6*d* schematically indicated in FIG. 7, the internal connections of the ports of the control valve are symbolically illustrated for four switching positions 6*f*, 6*g*, 6*h*, 6*i*.

To shift the control times of the gas exchange valves (not illustrated) in the direction of earlier control times, in the lead position 6*f* of the control valve 6, the first working port A and the control inlet port $St_{zu}$ are connected to the inlet port P and the second working port B is connected to the outlet port T. In this way, the group of first pressure chambers 4*a* is charged with pressure medium via pressure medium connections 7. At the same time, pressure medium passes out of the group of second pressure chambers 4*b* via pressure medium connections 8 to the control valve, and is discharged into the tank 19 via the outlet port T. In this way, the vanes 14 are moved in the direction of the early stop 17, thereby generating a rotational movement of the drive output part 3 relative to the drive input wheel 2 in the early direction. An adjustment in the direction of later control times in the lag position 6*h* is attained analogously. Here, the second working port B and the control inlet port $St_{zu}$ are connected to the inlet port P and the first working port A is connected to the outlet port T. Here, by virtue of the group of second pressure chambers 4*b* being charged with pressure medium via the pressure medium connections 8 and pressure medium simultaneously being discharged from the group of first pressure chambers 4*a* via the pressure medium connections 7 via the outlet port T into the tank 19, the vanes 14 are moved in the direction of the late stop 16, and a rotational movement of the drive output part 3 relative to the drive input wheel 2 in the late direction is obtained.

To hold the control times constant, the supply of pressure medium to all the pressure chambers 4*a*, 4*b* is prevented, while the control inlet port $St_{zu}$ is connected to the inlet port P (switching position 6*g*). In this way, the vanes 14 are hydraulically braced within the respective pressure spaces 4, and a rotational movement of the drive output part 3 relative to the drive input wheel 2 is prevented. To lock the camshaft adjusting apparatus 1, for example during the engine start or engine stop phase, the control outlet port $St_{ab}$ is connected to the outlet port T (switching position 6*i*), as a result of which pressure medium can flow out of the locking slotted guides $K_F$, $K_S$, $K_{R1}$, $K_{R2}$, $K_{R3}$ into the tank 19 and the locking elements F, S, R1, R2, R3 are moved into the locked state.

In the lead position 6*f*, the control inlet connection 9*a* of the locking device 5 and the group of first pressure chambers 4*a* are charged with pressure medium simultaneously via the pressure medium connection 7. Here, the control inlet connection 9*a* has a pressure medium connection to the group of pressure chambers 4*a* via the control inlet port St, and via the working port A of the control valve. Similarly, in the lag position 6*h*, the control inlet connection 9*a* and the group of pressure chambers 4*b* are charged with pressure medium simultaneously via the pressure medium connection 8, with the control inlet connection 9*a* having a pressure medium connection to the group of second pressure chambers 4*b* via the control outlet port $St_{zu}$ and via the working port B of the control valve.

A shut-off device 10 designed as a check valve is arranged in the control inlet connection 9*a*.

Since the check valve permits the passage of the pressure medium in the pass-through direction in the event of charging with pressure medium only when the opening pressure is exceeded, that is to say when the pressure difference, which is required for opening, upstream and downstream of the check valve is exceeded, pressure medium can flow in the control connection 9*a* only in the direction of the locking device 5 during an adjusting process both in the lead position 6*f* and also in the lag position 6*h* of the control valve. If the pressure difference required for opening is undershot, the check valve automatically closes and, directly in the control inlet connection 9*a*, blocks the passage of the pressure medium in the direction of the pressure spaces 4. In this way, a return flow of the pressure medium out of the control inlet connection 9*a* into the control valve is reliably prevented.

In this way, during an adjusting process both in the lead position 6*f* of the control valve and also in the lag position 6*h* of the control valve, it is ensured that the pressure medium pressure in the locking slotted guides $K_F$, $K_S$, $K_{R1}$, $K_{R2}$, $K_{R3}$ is permanently higher than the locking pressure. In this way, an inadvertent locking of the locking elements F, S, R1, R2, R3 or jamming of the locking elements F, S, R1, R2, R3 as they pass through the locking slotted guides $K_F$, $K_S$, $K_{R1}$, $K_{R2}$, $K_{R3}$ during an adjusting process can be prevented.

The check valve is formed with a blocking body 10*b* which is loaded in the blocking direction by a low spring force of a valve spring 10*a*, which blocking body hermetically seals off the control inlet connection 9*a* in the direction of the control valve. The check valve has a low opening pressure in the pass-through direction. Since only a small pressure difference upstream and downstream of the check valve in the control inlet connection 9*a* is required for opening, fast leakage compensation can be realized in the locking device 5 with a low throughflow rate and minimized flow resistance.

LIST OF REFERENCE SYMBOLS

1 Camshaft adjusting apparatus
1*a* Side facing away from the engine
1*b* Side facing toward the engine
2 Drive input wheel
2*a* Boundary wall
2*b* Boundary wall
2*c* Projection
2*d* Circumferential wall
3 Drive output part
3*a* Receptacle
3*b* Outer circumference
3*c* Vane groove
3*d* Axial bore
4 Pressure space
4*a* First pressure chamber
4*b* Second pressure chamber
5 Locking device
6 Regulating device
6*a* Actuating unit
6*b* Hydraulic section
6*c* Valve housing
6*d* Control piston
6*e* Valve spring
6*f* Lead position
6*g* Switching position
6*h* Lag position
6*i* Switching position
7 Pressure medium connection
8 Pressure medium connection
9 Pressure medium connection
9*a* Control inlet connection
9*b* Control outlet connection
10 Shut-off device
10*a* Valve spring
10*b* Blocking body
11 Side cover
11*a* Inner side
12 Side cover
13 Engagement point
14 Vane
16 Late stop
17 Early stop
18 Pressure medium pump
19 Tank
20 Stop
21 Stop
22 Stop
23 Stop
24 Stop
25 Fastening screw
F Locking element
S Locking element
R1 Locking element
R2 Locking element
R3 Locking element
$K_F$ Locking slotted guide
$K_S$ Locking slotted guide
$K_{R1}$ Locking slotted guide
$K_{R2}$ Locking slotted guide
$K_{R3}$ Locking slotted guide
A Working port
B Working port
$St_{zu}$ Control inlet port
$St_{ab}$ Control outlet port
P Inlet port
T Outlet port

The invention claimed is:

1. A camshaft adjusting apparatus, comprising:

a drive input wheel;

a drive output part rotatable relative to the drive input wheel, the drive input wheel and drive output part being operatively connected by at least one pressure space which can be charged with a pressure medium;

a locking device actuatable by the pressure medium to mechanically couple the drive input wheel and drive output part;

a regulating device comprising a control valve having a pressure medium connection with two working ports, which communicate with the pressure space, a control inlet port, separate from the working ports, and a control outlet port, separate from the working ports, the control inlet port and the control outlet port communicating with the locking device, the regulating device being operative to regulate a supply of the pressure medium to and a discharge of the pressure medium discharge from the pressure space and the locking device; and at least one shut-off device arranged in the pressure medium connection so that a passage of the pressure medium can be blocked in a pressure-tight manner in a direction of the pressure space, wherein the pressure medium connection has a control inlet connection that charges the locking device with the pressure medium and a control outlet connection in parallel with the control inlet connection for discharge of the pressure medium out of the locking device, the control inlet connection being in communication, at a valve side, with only the control inlet port and the check valve is arranged in the control inlet connection, the control outlet connection being in communication, at the valve side, with only the control outlet port.

2. The camshaft adjusting apparatus as claimed in claim 1, wherein the shutoff device is a check valve.

3. The camshaft adjusting apparatus as claimed in claim 2, wherein the check valve has a low opening pressure.

* * * * *